US009534283B2

(12) United States Patent
Na et al.

(10) Patent No.: US 9,534,283 B2
(45) Date of Patent: Jan. 3, 2017

(54) BULK NICKEL—SILICON—BORON GLASSES BEARING IRON

(71) Applicant: Glassimetal Technology, Inc., Pasadena, CA (US)

(72) Inventors: Jong Hyun Na, Pasadena, CA (US); Michael Floyd, Pasadena, CA (US); Marios D. Demetriou, West Hollywood, CA (US); William L. Johnson, San Marino, CA (US); Glenn Garrett, Pasadena, CA (US); Maximilien Launey, Pasadena, CA (US)

(73) Assignee: Glassimental Technology, Inc., Pasadena, CA (US)

( * ) Notice: Subject to any disclaimer, the term of this patent is extended or adjusted under 35 U.S.C. 154(b) by 396 days.

(21) Appl. No.: 14/149,035

(22) Filed: Jan. 7, 2014

(65) Prior Publication Data

US 2014/0190593 A1 Jul. 10, 2014
US 2015/0096652 A9 Apr. 9, 2015

Related U.S. Application Data

(60) Provisional application No. 61/749,860, filed on Jan. 7, 2013.

(51) Int. Cl.

| | |
|---|---|
| ***C22C 45/04*** | (2006.01) |
| ***C22C 1/02*** | (2006.01) |
| ***C22C 1/10*** | (2006.01) |
| ***C22F 1/10*** | (2006.01) |
| ***C22C 1/00*** | (2006.01) |

(Continued)

(52) U.S. Cl.
CPC ..... *C22F 1/10* (2013.01); *C22C 1/002* (2013.01); *C22C 19/03* (2013.01); *C22C 19/058* (2013.01); *C22C 33/003* (2013.01); *C22C 45/02* (2013.01); *C22C 45/04* (2013.01)

(58) Field of Classification Search
None
See application file for complete search history.

(56) References Cited

U.S. PATENT DOCUMENTS 3,856,513 A 12/1974 Chen et al.
4,116,682 A 9/1978 Polk et al.
(Continued)

FOREIGN PATENT DOCUMENTS

CN 1354274 6/2002
CN 1653200 8/2005
(Continued)

OTHER PUBLICATIONS

Habazaki et al., "Preparation of corrosion-resistant amorphous Ni—Cr—P—B bulk alloys containing molybdenum and tantalum," *Material Science and Engineering*, A304-A306, 2001, pp. 696-700.
(Continued)

*Primary Examiner* — George Wyszomierski
(74) *Attorney, Agent, or Firm* — Polsinelli PC

(57) ABSTRACT

Ni—Fe—Si—B and Ni—Fe—Si—B—P metallic glass forming alloys and metallic glasses are provided. Metallic glass rods with diameters of at least one, up to three millimeters, or more can be formed from the disclosed alloys. The disclosed metallic glasses demonstrate high yield strength combined with high corrosion resistance, while for a relatively high Fe contents the metallic glasses are ferromagnetic.

20 Claims, 12 Drawing Sheets

(51) Int. Cl.

| | |
|---|---|
| ***C22C 19/03*** | (2006.01) |
| ***C22C 19/05*** | (2006.01) |
| ***C22C 33/00*** | (2006.01) |
| ***C22C 45/02*** | (2006.01) |

(56) References Cited

U.S. PATENT DOCUMENTS

| | | | | |
|---|---|---|---|---|
| 4,126,284 | A | 11/1978 | Ichikawa et al. | |
| 4,144,058 | A | 3/1979 | Chen et al. | |
| 4,152,144 | A | 5/1979 | Hasegawa et al. | |
| 4,385,932 | A | 5/1983 | Inomata et al. | |
| 4,582,536 | A | 4/1986 | Raybould | |
| 4,892,628 | A | 1/1990 | Guilinger | |
| 4,900,638 | A | 2/1990 | Emmerich | |
| 4,968,363 | A | 11/1990 | Hashimoto et al. | |
| 5,338,376 | A * | 8/1994 | Liu | H01F 1/15308 148/304 |
| 5,429,725 | A | 7/1995 | Thorpe et al. | |
| 5,634,989 | A | 6/1997 | Hashimoto et al. | |
| 6,004,661 | A * | 12/1999 | Sakai | H01F 1/15308 148/403 |
| 6,303,015 | B1 | 10/2001 | Thorpe et al. | |
| 6,325,868 | B1 | 12/2001 | Kim et al. | |
| 6,695,936 | B2 * | 2/2004 | Johnson | B22D 13/04 148/403 |
| 8,287,664 | B2 | 10/2012 | Brunner | |
| 2005/0263216 | A1 | 12/2005 | Chin et al. | |
| 2006/0213586 | A1 * | 9/2006 | Kui | C22C 38/02 148/400 |
| 2007/0175545 | A1 | 8/2007 | Urata et al. | |
| 2009/0110955 | A1 | 4/2009 | Hartmann et al. | |
| 2012/0073710 | A1 | 3/2012 | Kim et al. | |
| 2012/0168037 | A1 | 7/2012 | Demetriou et al. | |
| 2013/0048152 | A1 | 2/2013 | Na et al. | |
| 2014/0213384 | A1 | 7/2014 | Johnson et al. | |
| 2014/0238551 | A1 | 8/2014 | Na et al. | |
| 2015/0047755 | A1 | 2/2015 | Na et al. | |
| 2015/0158126 | A1 | 6/2015 | Hartmann et al. | |
| 2015/0159242 | A1 | 6/2015 | Na et al. | |
| 2015/0176111 | A1 | 6/2015 | Na et al. | |
| 2015/0240336 | A1 | 8/2015 | Na et al. | |

FOREIGN PATENT DOCUMENTS

| | | |
|---|---|---|
| DE | 3929222 | 3/1991 |
| DE | 102011001783 | 10/2012 |
| DE | 102011001784 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

Park T.G. et al., "Development of new Ni-based amorphous alloys containing no metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

Habazaki et al., "Corrosion behaviour of amorphous Ni—Cr—Nb—P—B bulk alloys in 6M HCI solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

U.S. Appl. No. 14/029,719, filed Sep. 17, 2013, Na et al.

U.S. Appl. No. 14/048,894, filed Oct. 8, 2013, Na et al.

U.S. Appl. No. 14/067,521, filed Oct. 30, 2013, Na et al.

U.S. Appl. No. 14/077,830, filed Nov. 12, 2013, Na et al.

U.S. Appl. No. 14/081,622, filed Nov. 15, 2013, Na et al.

U.S. Appl. No. 14/501,779, filed Sep. 30, 2014, Na et al.

U.S. Appl. No. 14/824,733, filed Aug. 12, 2015, Na et al.

U.S. Appl. No. 14/797,878, filed Jul. 13, 2015, Na et al.

* cited by examiner

BULK NICKEL—SILICON—BORON GLASSES BEARING IRON

CROSS-REFERENCE TO RELATED APPLICATIONS

The present application claims the benefit of U.S. Provisional Patent Application No. 61/749,860, entitled "Bulk Nickel-Silicon-Boron Glasses Bearing Iron," filed on Jan. 7, 2013, which is incorporated herein by reference in its entirety.

FIELD

The disclosure is directed to Ni—Si—B alloys bearing Fe and optionally P capable of forming bulk metallic glass rods with diameters of 1 mm or greater. More specifically, the disclosure relates to adding iron (Fe) and/or phosphorus (P) to Ni—Si—B alloys to improve metallic glass-forming ability (GFA).

BACKGROUND

Japanese patent JP-08-269647 (1996), entitled "Ni-Based Amorphous Metallic Filament", by Takeshi Masumoto, et al., discloses $Ni_{100-b-c}Si_bB_c$ alloys, where 3<b<17 and 10<c<27 (subscripts b, c denote atomic percent). Amorphous wires with diameters on the order of tens of micrometers can be produced from these alloys via a spinning method in a rotating liquid. The Japanese patent discloses that Cr, Co, Nb, Ta, Mo, V, W, Mn, Cu, P, C, Ge as well as Fe could be added "within limits that do not impair the processability of the amorphous phase," while improving the tensile strength, the heat resistance, and corrosion resistance of the alloys. An example of a Ni—Si—B alloy containing 4% Fe along with 13% Cr is reported in the Japanese patent having a diameter of 50 micrometers. However, such early Ni—Si—B alloys are generally limited to forming metallic glass wires having diameters below 200 micrometers. JP-08-269647 discloses that "crystalline phases generally emerge and the processability worsens when the wires exceed 200 micrometers."

U.S. Pat. No. 4,144,058 by Chen et al. discloses iron (Fe)-nickel (Ni) alloys bearing phosphorus (P) and boron (B) and optionally silicon (Si) that vary over a very broad range of atomic compositions. The disclosed alloys capable of forming amorphous sheets, ribbons, or powders with lateral dimensions on the order of tens of micrometers. Chen et al. does not disclose forming bulk Ni—Fe metallic glasses, or suggest that bulk metallic glass formation may be possible.

There is a need for Ni—Fe—Si—B bulk metallic glasses having improved properties, including high strength and toughness, bending ductility, ferromagnetic properties, and corrosion resistance. These and other needs are addressed by the present disclosure.

BRIEF SUMMARY

The present disclosure provides Ni—Fe—Si—B and Ni—Fe—Si—B—P alloys and metallic glasses. Metallic glass rods with diameters of at least one and up to several millimeters can be formed from the disclosed alloys. In various embodiments, Ni—Fe—Si—B—P alloys contain P in concentrations ranging from 0.5 atomic percent to 8 atomic percent.

The disclosure is directed to an alloy, or a metallic glass, represented by the following formula (subscripts denote atomic percent):

$$Ni_{(100-a-b-c)}Fe_aSi_bB_c \quad \text{Eq. (1)}$$

where:

a is between 5 and 50 b is between 10 and 14 c is between 9 and 13 and wherein the alloy is capable of forming a metallic glass rod having a diameter of at least 1 mm.

In another embodiment, a in Eq. (1) is between 15 and 50, b is between 10 and 14, and c is between 9 and 13, wherein the alloy is capable of forming a metallic glass rod having a diameter of at least 1 mm.

In yet another embodiment, a in Eq. (1) is between 25 and 40, and wherein the alloy is capable of forming a metallic glass rod having a diameter of at least 1 mm.

In another embodiment, b+c in Eq. (1) is between 21 and 24.

The disclosure is also directed to an alloy, or a metallic glass, represented by the following formula (subscripts denote atomic percent):

$$Ni_{(100-a-b-c-d)}Fe_aSi_bB_cP_d \quad \text{Eq. (2)}$$

where:

a is between 5 and 50 b is between 7 and 10 c is between 7 and 10 d is between 0.5 and 8 and wherein the alloy is capable of forming a metallic glass rod having a diameter of at least 1 mm.

In yet another embodiment, a in Eq. (2) is between 20 and 30, and wherein the alloy is capable of forming a metallic glass rod having a diameter of at least 2 mm.

In another embodiment, a in Eq. (2) is between 20 and 45, b is between 7 and 10, c is between 7 and 10, d is between 0.5 and 8, and wherein the alloy is capable of forming a metallic glass rod having a diameter of at least 2 mm.

In another embodiment, b+c+d in Eq. (2) is between 21 and 23.

In yet another embodiment, up to 3 atomic % of Ni is substituted by Cr.

In yet another embodiment, up to 3 atomic % of Fe is substituted by Cr.

In yet another embodiment, up to 1.5 atomic % of Fe is substituted by Co, Mn, W, Mo, Ru, Re, Cu, Pd, Pt, Nb, V, Ta, or combinations thereof.

In yet another embodiment, up to 1.5 atomic % of Ni is substituted by Co, Mn, W, Mo, Ru, Re, Cu, Pd, Pt, Nb, V, Ta, or combinations thereof.

The disclosure is also directed to alloy compositions selected from a group consisting of $Ni_{52}Fe_{25}Si_{12}B_{11}$, $Ni_{47}Fe_{30}Si_{12}B_{11}$, $Ni_{44.5}Fe_{32.5}Si_{12}B_{11}$, $Ni_{42}Fe_{35}Si_{12}B_{11}$, $Ni_{39.5}Fe_{37.5}Si_{12}B_{11}$, $Ni_{37}Fe_{40}Si_{12}B_{11}$, $Ni_{53}Fe_{25}Si_8B_{10}P_4$, $Ni_{53}Fe_{25}Si_8B_9P_5$, $Ni_{53}Fe_{25}Si_9B_9P_4$, $Ni_{53}Fe_{25}Si_7B_9P_6$, $Ni_{53}Fe_{25}Si_7B_{10}P_5$, $Ni_{53.68}Fe_{25.32}Si_{7.64}B_{8.59}P_{4.77}$, $Ni_{52.32}Fe_{24.68}Si_{8.36}B_{9.41}P_{5.23}$, $Ni_{54}Fe_{24}Si_8B_9P_5$, and $Ni_{52}Fe_{26}Si_8B_9P_5$.

The disclosure is also directed to metallic glass compositions selected from a group consisting of $Ni_{52}Fe_{25}Si_{12}B_{11}$, $Ni_{47}Fe_{30}Si_{12}B_{11}$, $Ni_{44.5}Fe_{32.5}Si_{12}B_{11}$, $Ni_{42}Fe_{35}Si_{12}B_{11}$, $Ni_{39.5}Fe_{37.5}Si_{12}B_{11}$, $Ni_{37}Fe_{40}Si_{12}B_{11}$, $Ni_{53}Fe_{25}Si_8B_{10}P_4$, $Ni_{53}Fe_{25}Si_8B_9P_5$, $Ni_{53}Fe_{25}Si_9B_9P_4$, $Ni_{53}Fe_{25}Si_7B_9P_6$, $Ni_{53}Fe_{25}Si_7B_{10}P_5$, $Ni_{53.68}Fe_{25.32}Si_{7.64}B_{8.59}P_{4.77}$, $Ni_{52.32}Fe_{24.68}Si_{8.36}B_{9.41}P_{5.23}$, $Ni_{54}Fe_{24}Si_8B_9P_5$, and $Ni_{52}Fe_{26}Si_8B_9P_5$.

In a further embodiment, a method is provided for forming a bulk metallic glass having one of the disclosed compositions. The method includes melting an alloy described herein into a molten state, and quenching the molten alloy at a cooling rate sufficiently rapid to prevent crystallization of the alloy. The method also can include a step of fluxing of the molten alloy prior to quenching by using a reducing agent to improve the glass-forming ability.

In yet another embodiment, the melt (i.e. the molten alloy) is fluxed with a reducing agent prior to rapid quenching.

In yet another embodiment, the reducing agent is boron oxide.

In yet another embodiment, the temperature of the melt prior to quenching is at least 100° C. above the liquidus temperature of the alloy.

In yet another embodiment, the temperature of the melt prior to quenching is at least 1100° C.

In yet another embodiment, the step of melting the alloy comprises melting the alloy in a crucible, where the crucible is made of fused silica, crystalline silica, a ceramic such as alumina or zirconia, graphite, or a water-cooled hearth made of copper or silver.

In yet another embodiment, the step of quenching the melt comprises quenching the crucible containing the melt in a bath of room temperature water, iced water, or oil.

In yet another embodiment, the step of quenching the melt comprises injecting or pouring the melt into a metal mold, made, for example, of copper, brass, or steel.

In yet another embodiment, a bulk metallic glass article made from the alloys having a lateral dimension of up to 1 mm can undergo macroscopic plastic bending under load without fracturing catastrophically.

In yet another embodiment, a bulk metallic glass article comprises a ferromagnetic core. Non-limiting applications selected from the group consisting of inductors, transformers, clutches, and DC/AC converters.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure.

BRIEF DESCRIPTION OF THE DRAWINGS

The description will be more fully understood with reference to the following figures, which are presented as various embodiments of the disclosure and should not be construed as a complete recitation of the scope of the disclosure. It is noted that, for purposes of illustrative clarity, certain elements in various drawings may not be drawn to scale.

DETAILED DESCRIPTION

Figure 1:
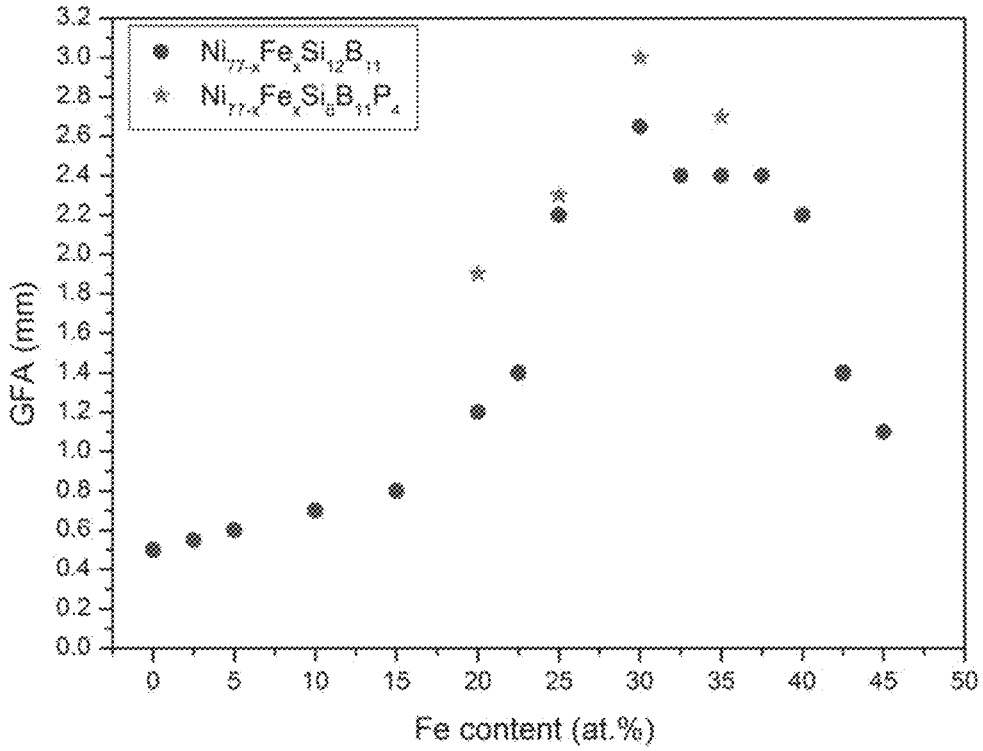
FIG. 1 provides a data plot showing the effect of Fe atomic concentration on the glass forming ability (GFA) of the Ni—Fe—Si—B and Ni—Fe—Si—B—P alloys in accordance with embodiments of the disclosure.

The present disclosure may be understood by reference to the following detailed description, taken in conjunction with the drawings as described herein.

Description of Alloy Compositions

In accordance with the provided disclosure and drawings, Ni—Fe—Si—B and Ni—Fe—Si—B—P alloys are provided that surprisingly require very low cooling rates to form metallic glass. The alloys can form bulk metallic glasses having a lateral dimension of at least 1 mm. Specifically, by controlling the relative concentration of Fe to be from 15 to 50 atomic percent, the Ni—Fe—Si—B and Ni—Fe—Si—B—P alloys can form metallic glass rods with diameters of at least 1 mm.

In some embodiments, to further promote glass formation, the disclosure adds P in the Ni—Fe—Si—B alloys. Specifically, an addition of P up to about 8% is shown to significantly improve glass forming ability.

In some embodiments, the disclosure also demonstrates the substitution of Ni or Fe by Cr in Ni—Fe—Si—B alloys.

In various embodiments, the disclosure demonstrates that the process of fluxing prior to melt quenching improves the glass-forming ability. Fluxing is a chemical process by which the fluxing agent acts to "reduce" the oxide inclusions entrained in the glass-forming alloy that could potentially impair glass formation by catalyzing crystallization. Whether fluxing is beneficial in promoting glass formation can be determined by the composition of the alloy, the inclusion chemistry, and the fluxing agent chemistry. For the alloys claimed in the instant disclosure, fluxing with $B_2O_3$ was determined to dramatically improve bulk-glass formation. Fluxing Ni—Fe—Si—B and Ni—Fe—Si—B—P alloys with $B_2O_3$ to improve glass forming ability has not been disclosed in either Masumoto or Chen.

The disclosure provides alloys that have a good glass forming ability. The Ni—Fe—Si—B—P alloys capable of forming metallic glasses rods with diameters of at least 1 mm and up to 3 mm or larger, thereby show significantly better glass forming ability than the metallic glasses disclosed in JP-08-269647 by Masumoto et al. The alloys by Masumoto et al. were only capable of forming metallic wires with diameters of up to about 200 micrometers. The alloys and amorphous wires disclosed by Masumoto et al. contained Fe only optionally, so long as they don't impair the ability of the alloys to form amorphous wires of up to 200 micrometers in diameter. In various embodiments of the present disclosure, the addition of Fe between 15 and 50 at % in the disclosed range results in the improved GFA over the alloys and metallic glasses disclosed by Masumoto et al. In some embodiments, the presently disclosed alloys have a peak GFA around 30 at %.

The glass-forming ability of each alloy in the disclosure was assessed by determining the maximum or "critical" rod diameter, defined as maximum rod diameter in which the amorphous phase can be formed when processed by the method of water quenching the molten alloy in quartz capillaries or tubes. Since quartz is known to be a poor heat conductor that retards heat transfer, the quartz thickness is a critical parameter associated with the glass-forming ability of the example alloys. Therefore, to quantify the glass-forming ability of each of the example alloys, the critical rod diameter, $d_c$, is reported in conjunction with the associated quartz thickness, $t_w$, of the capillary or tube used to process the alloy.

A "critical cooling rate", which is defined as the cooling rate required to avoid crystallization and form the amorphous phase of the alloy (i.e. the metallic glass) determines the critical rod diameter. The lower the critical cooling rate of an alloy, the larger its critical rod diameter. The critical cooling rate $R_c$ in K/s and critical rod diameter $d_c$ in mm are related via the following approximate empirical formula:

$$R_c=1000/d_c^2 \quad \text{Eq. (3)}$$

According to Eq. (3), the critical cooling rate for an alloy having a critical rod diameter of about 1 mm, as in the case of the alloys according to embodiments of the present disclosure, is only about $10^3$ K/s.

Generally, three categories are known in the art for identifying the ability of a metal alloy to form glass (i.e. to bypass the stable crystal phase and form an amorphous phase). Metal alloys having critical cooling rates in excess of $10^{12}$ K/s are typically referred to as non-glass formers, as it is physically impossible to achieve such cooling rates over a meaningful thickness. Metal alloys having critical cooling rates in the range of $10^5$ to $10^{12}$ K/s are typically referred to as marginal glass formers, as they are able to form glass over thicknesses ranging from 1 to 100 micrometers according to Eq. (3). Metal alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of a metallic alloy is, to a very large extent, dependent on the combination and composition of the alloy. The combinational and compositional ranges of alloys capable of forming marginal glass formers are considerably broader than those for forming bulk glass formers.

Ni—Fe—Si—B and Ni—Fe—Si—B—P Alloys and Metallic Glasses

In various embodiments, quartz capillaries with wall thicknesses roughly 10% of the tube diameter can be used to process the alloys.

Specific embodiments of Ni—Fe—Si—B alloys and metallic glasses that demonstrate the effect on GFA according to Eq. (1) are presented in Table 1. These alloys are processed in quartz capillaries with wall thicknesses roughly 10% of the tube inner diameter at 1250° C. Example alloys 1-15 have compositions according to $Ni_{77-x}Fe_xSi_{12}B_{11}$, where the Fe atomic percent x varies between 0 and 45. The data shows that bulk-glass formation is possible over the disclosed range of Fe and Ni concentrations. A peak GFA at Fe composition 30 at. % is observed. At this peak GFA, a $d_{cr}$ value of 2.65 mm is obtained.

TABLE 1

Example alloys according to Eq. (1) processed in quartz capillaries to form metallic glasses

| Example | Composition [at %] | $d_c$ [mm] | $t_w$ [mm] |
|---|---|---|---|
| 1 | $Ni_{77}Si_{12}B_{11}$ | 0.5 | 0.05 |
| 2 | $Ni_{74.5}Fe_{2.5}Si_{12}B_{11}$ | 0.55 | 0.055 |
| 3 | $Ni_{72}Fe_5Si_{12}B_{11}$ | 0.6 | 0.06 |
| 4 | $Ni_{67}Fe_{10}Si_{12}B_{11}$ | 0.7 | 0.07 |
| 5 | $Ni_{62}Fe_{15}Si_{12}B_{11}$ | 0.8 | 0.08 |
| 6 | $Ni_{57}Fe_{20}Si_{12}B_{11}$ | 1.2 | 0.12 |
| 7 | $Ni_{54.5}Fe_{22.5}Si_{12}B_{11}$ | 1.4 | 0.14 |
| 8 | $Ni_{52}Fe_{25}Si_{12}B_{11}$ | 2.2 | 0.22 |
| 9 | $Ni_{47}Fe_{30}Si_{12}B_{11}$ | 2.65 | 0.265 |
| 10 | $Ni_{44.5}Fe_{32.5}Si_{12}B_{11}$ | 2.4 | 0.24 |
| 11 | $Ni_{42}Fe_{35}Si_{12}B_{11}$ | 2.4 | 0.24 |
| 12 | $Ni_{39.5}Fe_{37.5}Si_{12}B_{11}$ | 2.4 | 0.24 |
| 13 | $Ni_{37}Fe_{40}Si_{12}B_{11}$ | 2.2 | 0.22 |
| 14 | $Ni_{34.5}Fe_{42.5}Si_{12}B_{11}$ | 1.4 | 0.14 |
| 15 | $Ni_{32}Fe_{45}Si_{12}B_{11}$ | 1.1 | 0.11 |

Ni—Fe—Si—B—P alloys and metallic glasses demonstrating the effect on GFA of Ni by Fe Ni according to the formula given by Eq. (2) are presented in Table 2. These alloys are processed in quartz capillaries with wall thicknesses roughly 10% of the tube inner diameter at 1300° C. Example alloys 16-19 have compositions according to $Ni_{77-x}Fe_xSi_8B_{11}P_4$ where the Fe atomic percent x varies between 20 and 35. Compared to the Ni—Fe—Si—B alloys presented in Table 1, in the embodiments presented in Table 2, 4 at % of Si is substituted by P such that the total of the metalloid content (Si+B+P) is 23.

Like the disclosed Ni—Fe—Si—B alloys, a peak in GFA at Fe concentration of 30 at. % is observed in the Ni—Fe—Si—B—P alloys, where a $d_{cr}$ value of 3 mm is obtained. Incorporating P in the Ni—Fe—Si—B alloys as a substitution for Si improves GFA for the alloys of Eq. (2).

TABLE 2

Example alloys according to Eq. (2) processed in quartz capillaries to form metallic glasses

| Example | Composition [at %] | $d_c$ [mm] | $t_w$ [mm] |
|---|---|---|---|
| 16 | $Ni_{57}Fe_{20}Si_8B_{11}P_4$ | 1.9 | 0.19 |
| 17 | $Ni_{52}Fe_{25}Si_8B_{11}P_4$ | 2.3 | 0.23 |

TABLE 2-continued

Example alloys according to Eq. (2) processed in quartz capillaries to form metallic glasses

| Example | Composition [at %] | $d_c$ [mm] | $t_w$ [mm] |
|---|---|---|---|
| 18 | $Ni_{47}Fe_{30}Si_8B_{11}P_4$ | 3.0 | 0.3 |
| 19 | $Ni_{42}Fe_{35}Si_8B_{11}P_4$ | 2.7 | 0.27 |

FIG. 1 depicts a plot of the data of Table 1 and Table 2 that shows the effect of increasing the Fe atomic concentration Ni—Fe—Si—B and Ni—Fe—Si—B—P alloys.

When the Fe atomic percent a is between 25 and 40, Ni—Fe—Si—B metallic glass rods with diameters of at least 2 mm can be formed. Metallic glass rods with diameters of at least 1 mm are formed when a is from about 5 to about 50. Alternatively, in various embodiments, metallic glass rods with diameters of at least 1 mm are formed when a is from about 15 to about 50. Alloys within the disclosed composition range demonstrate surprisingly higher glass forming ability than alloys with compositions outside the composition range.

When a is between 20 and 30, Ni—Fe—Si—B—P metallic glass rods with diameters of at least 2 mm can be formed. Alternatively, when a is between 20 and 45, Ni—Fe—Si—B—P metallic glass rods with diameters of at least 2 mm can be formed. Metallic glass rods with diameters of at least 1 mm are formed over a range of a from about 5 to about 50. Alloys the disclosed composition range demonstrate surprisingly higher glass forming ability than alloys with compositions outside the Fe ranges disclosed herein.

Figure 2:
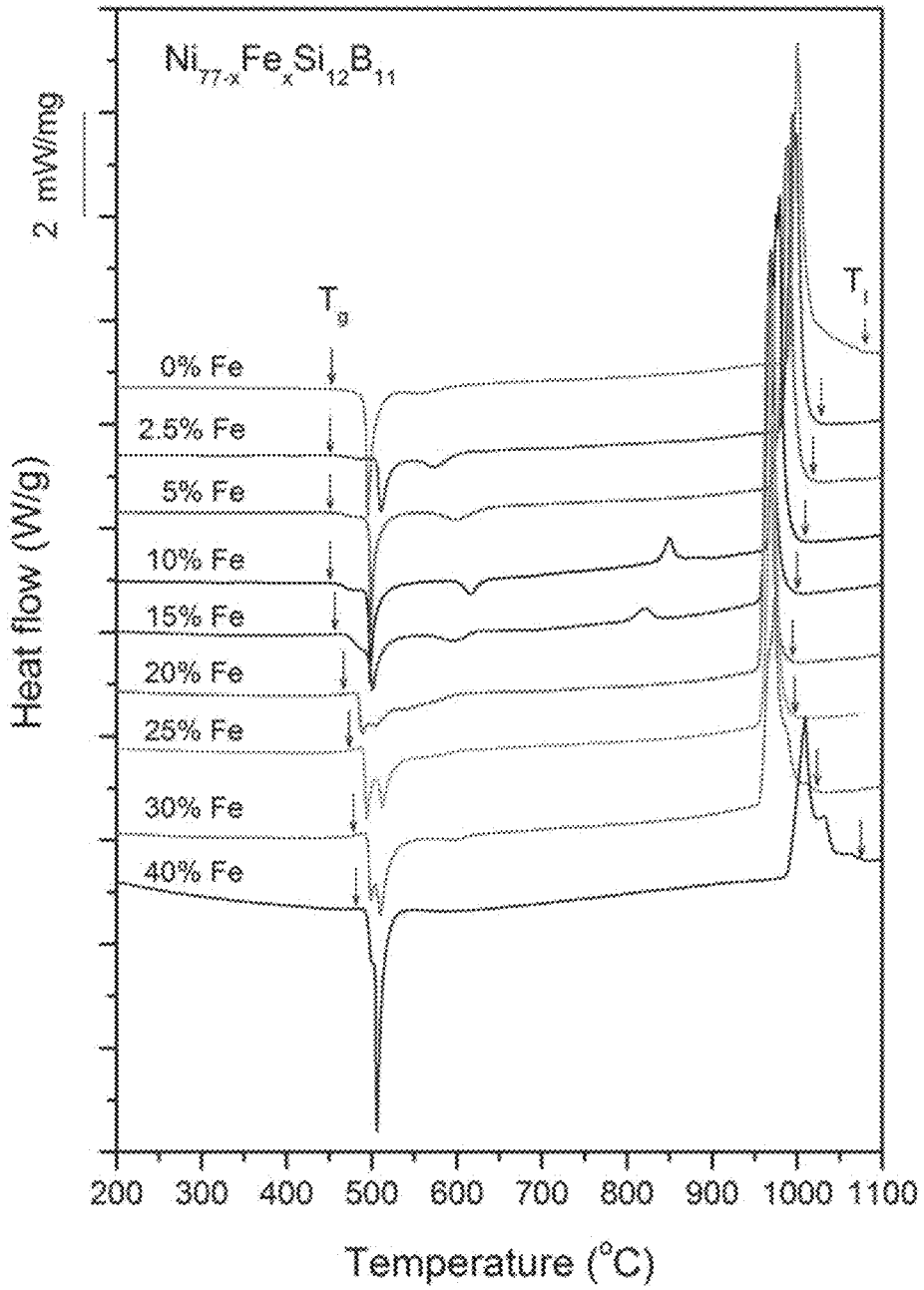
FIG. 2 provides calorimetry scans for example metallic glasses Ni—Fe—Si—B from Table 1 with varying Fe atomic concentration in accordance with embodiments of the disclosure. Arrows from left to right designate the glass transition and liquidus temperatures, respectively.

FIG. 2 provides calorimetry scans for Ni—Fe—Si—B metallic glasses having compositions according to $Ni_{77-x}Fe_xSi_{12}B_{11}$, as shown in Table 1 according to embodiments of the present disclosure. The arrows designate the liquidus temperatures of the alloys. Based on the calorimetry scans, the Ni—Fe—Si—B alloys have lower liquidus temperatures as compared to those of the ternary Ni—Si—B alloys. The scans show a reduction in the liquidus temperature near an Fe concentration of 30 at. %, with the minimum of just under 1000° C. occurring at an Fe concentration of 25 at. %. A lower liquidus temperature can imply a higher GFA. An increasing glass transition temperature with increasing Fe composition is also revealed. A higher glass-transition temperature can imply a higher GFA. The alloy with Fe composition of 30 at. % demonstrates the combination of low liquidus temperature and high glass-transition temperature.

In various additional embodiments, quartz tubes with fixed wall thickness of 0.5 mm can be used to process various alloys. Example alloys 20-30 with compositions that satisfy the disclosed composition formula given by Eq. (2) are presented in Table 3. These alloys are processed in quartz tubes with 0.5 mm wall thickness at 1250° C. In particular, the alloy having the composition $Ni_{53}Fe_{25}Si_8B_9P_5$ (Example 21) is a better glass former than other example alloys, as it is capable of forming metallic glass rods of up to 3 mm in diameter.

Figure 3:
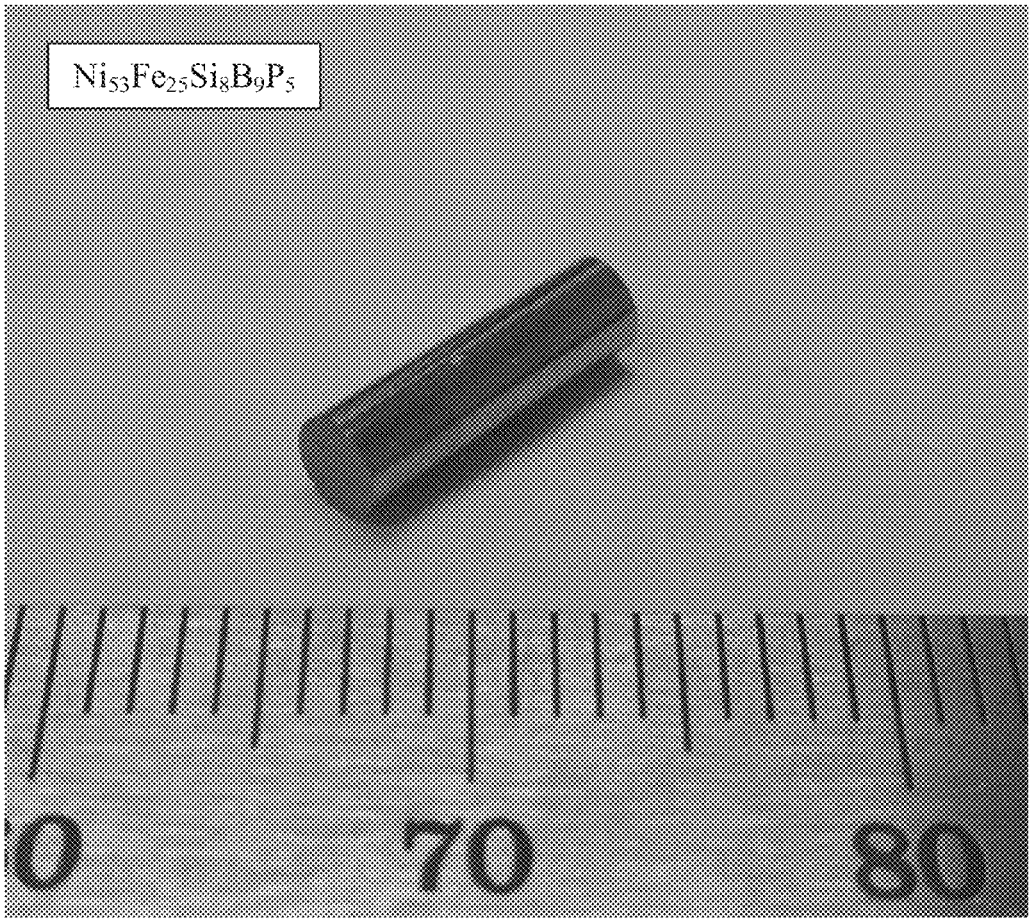
FIG. 3 provides an image of an amorphous 3 mm rod of example metallic glass $Ni_{53}Fe_{25}Si_8B_9P_5$ in accordance with embodiments of the disclosure.
Figure 4:
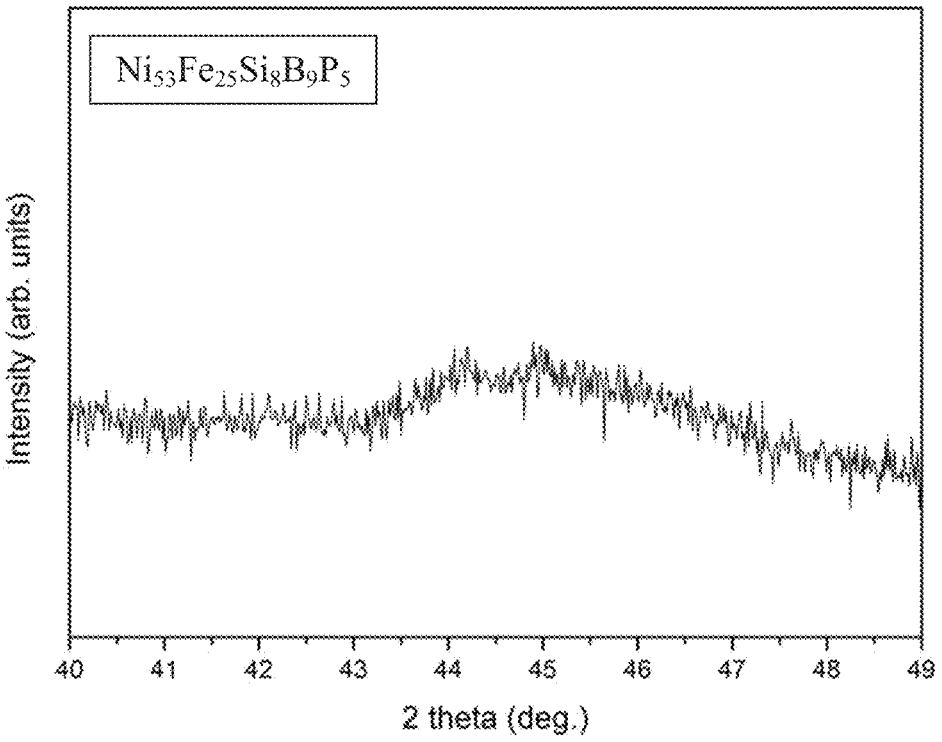
FIG. 4 provides an X-ray diffractogram verifying the amorphous structure of a 3 mm rod of example metallic glass $Ni_{53}Fe_{25}Si_8B_9P_5$ in accordance with embodiments of the disclosure.

An amorphous 3-mm rod of metallic glass $Ni_{53}Fe_{25}Si_8B_9P_5$ is shown in FIG. 3, while the x-ray diffractogram verifying the amorphous structure of the metallic glass rod is shown in FIG. 4.

TABLE 3

Example alloys according to Eq. (2) processed in quartz tubes to form metallic glasses

| Example | Composition [at %] | $d_c$ [mm] | $t_w$ [mm] |
|---|---|---|---|
| 20 | $Ni_{53}Fe_{25}Si_8B_{10}P_4$ | 2.0 | 0.5 |
| 21 | $Ni_{53}Fe_{25}Si_8B_9P_5$ | 3.0 | 0.5 |
| 22 | $Ni_{53}Fe_{25}Si_8B_8P_6$ | 1.0 | 0.5 |
| 23 | $Ni_{53}Fe_{25}Si_9B_9P_4$ | 2.0 | 0.5 |
| 24 | $Ni_{53}Fe_{25}Si_7B_9P_6$ | 2.0 | 0.5 |
| 25 | $Ni_{53}Fe_{25}Si_7B_{10}P_5$ | 2.0 | 0.5 |
| 26 | $Ni_{53}Fe_{25}Si_9B_8P_5$ | 1.0 | 0.5 |
| 27 | $Ni_{53.68}Fe_{25.32}Si_{7.64}B_{8.59}P_{4.77}$ | 2.0 | 0.5 |
| 28 | $Ni_{52.32}Fe_{24.68}Si_{8.36}B_{9.41}P_{5.23}$ | 2.0 | 0.5 |
| 29 | $Ni_{54}Fe_{24}Si_8B_9P_5$ | 2.5 | 0.5 |
| 30 | $Ni_{52}Fe_{26}Si_8B_9P_5$ | 2.5 | 0.5 |

Figure 5:
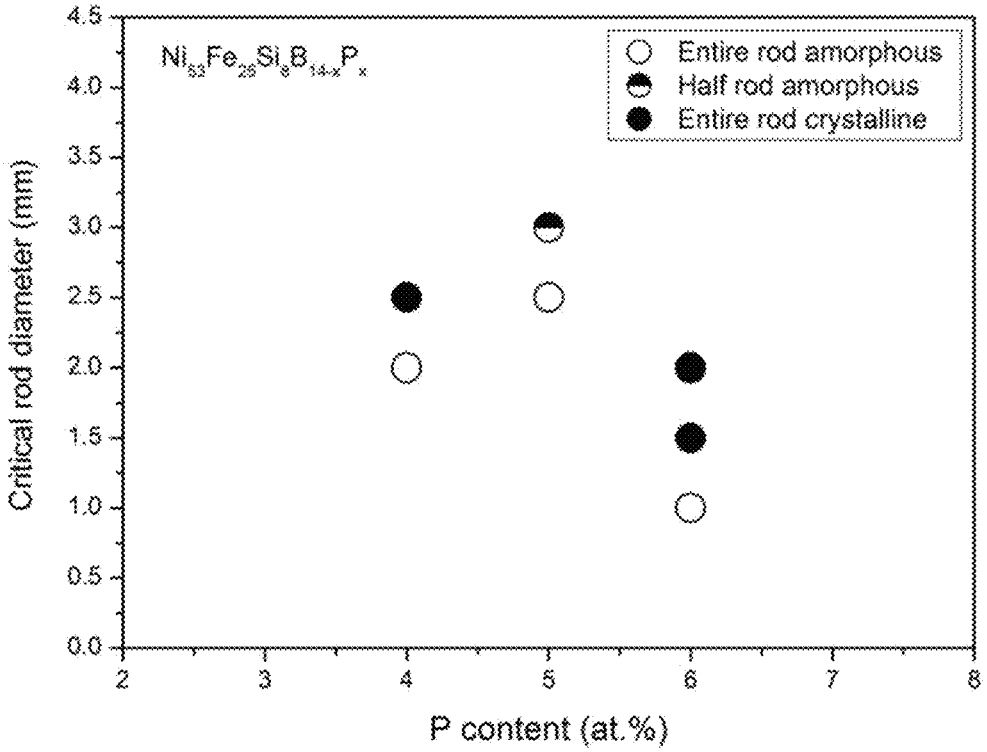
FIG. 5 provides data plots showing the effect of substituting B by P on the GFA of Ni—Fe—Si—B—P alloys according to the formula $Ni_{53}Fe_{25}Si_8B_{14-x}P_x$, where the atomic percent x ranges from 4 to 6 in accordance with embodiments of the disclosure.

Example alloys 20-22 demonstrate the effect of varying the atomic concentration of P at the expense of B on the GFA of the Ni—Fe—Si—B—P alloys according to the formula $Ni_{53}Fe_{25}Si_8B_{14-x}P_x$, where the P atomic percent x ranges from 4 to 6. A peak in the GFA occurs at a P concentration of 5 at %, associated with the formation of metallic glass rods of 3 mm in diameter. These results are presented graphically in FIG. 5.

Figure 6:
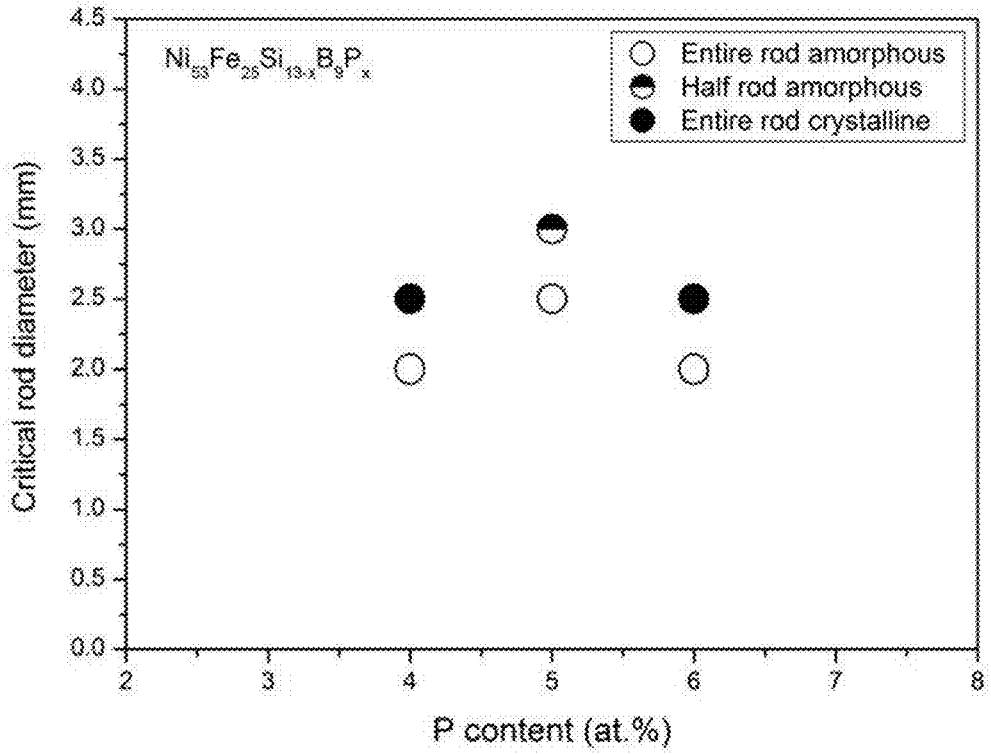
FIG. 6 provides data plots showing the effect of substituting Si by P on the GFA of the Ni—Fe—Si—B—P alloys according to the formula $Ni_{53}Fe_{25}Si_{13-x}B_9P_x$, where the atomic percent x ranges from 4 to 6 in accordance with embodiments of the disclosure.

Example alloys 21, 23, and 24 demonstrate the effect of varying the atomic concentration of P at the expense of Si on the GFA of the Ni—Fe—Si—B—P alloys according to the formula $Ni_{53}Fe_{25}Si_{13-x}B_9P_x$, where the P atomic percent x ranges from 4 to 6. These results are presented graphically in FIG. 6, which shows that the largest metallic glass rod of 3 mm in diameter can be formed at a P concentration of 5 at %.

Figure 7:
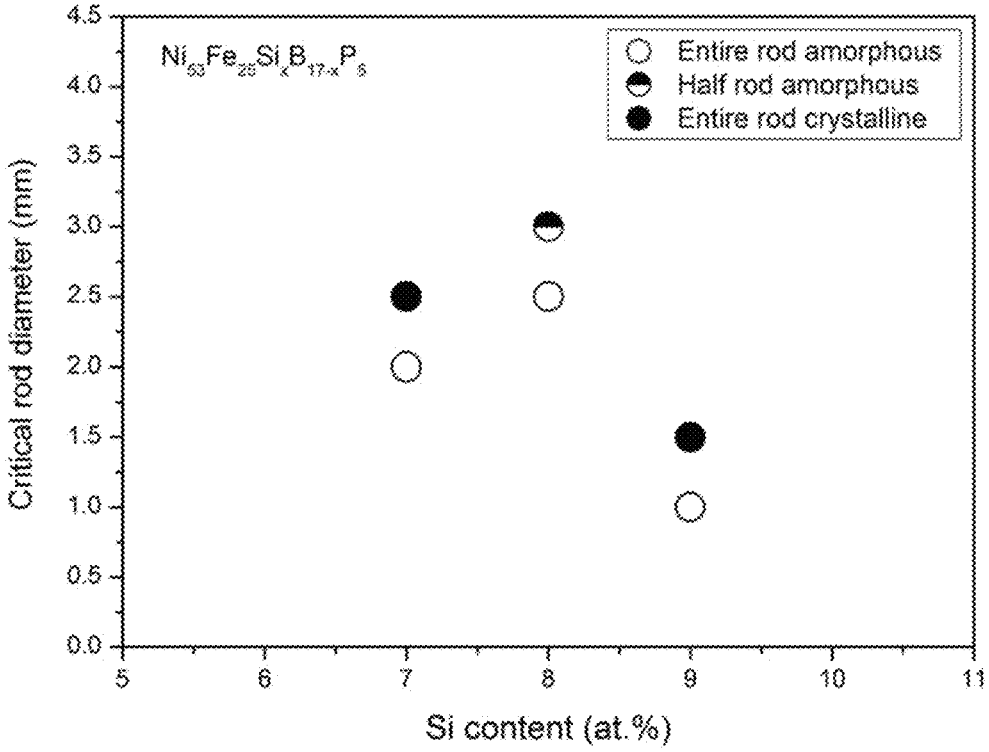
FIG. 7 provides data plots showing the effect of substituting B by Si on the GFA of the Ni—Fe—Si—B—P alloys according to the formula $Ni_{53}Fe_{25}Si_xB_{17-x}P_5$, where the atomic percent x ranges from 7 to 9 in accordance with embodiments of the disclosure.

Example alloys 21, 25, and 26 demonstrate the effect of varying the atomic concentration of Si at the expense of B on the GFA of the Ni—Fe—Si—B—P alloys according to the formula $Ni_{53}Fe_{25}Si_xB_{17-x}P_5$, where the Si atomic percent x ranges from 7 to 9. These results are presented graphically in FIG. 7, which shows that the largest metallic glass rod of 3 mm in diameter can be formed at a Si concentration of 8 at %.

Figure 8:
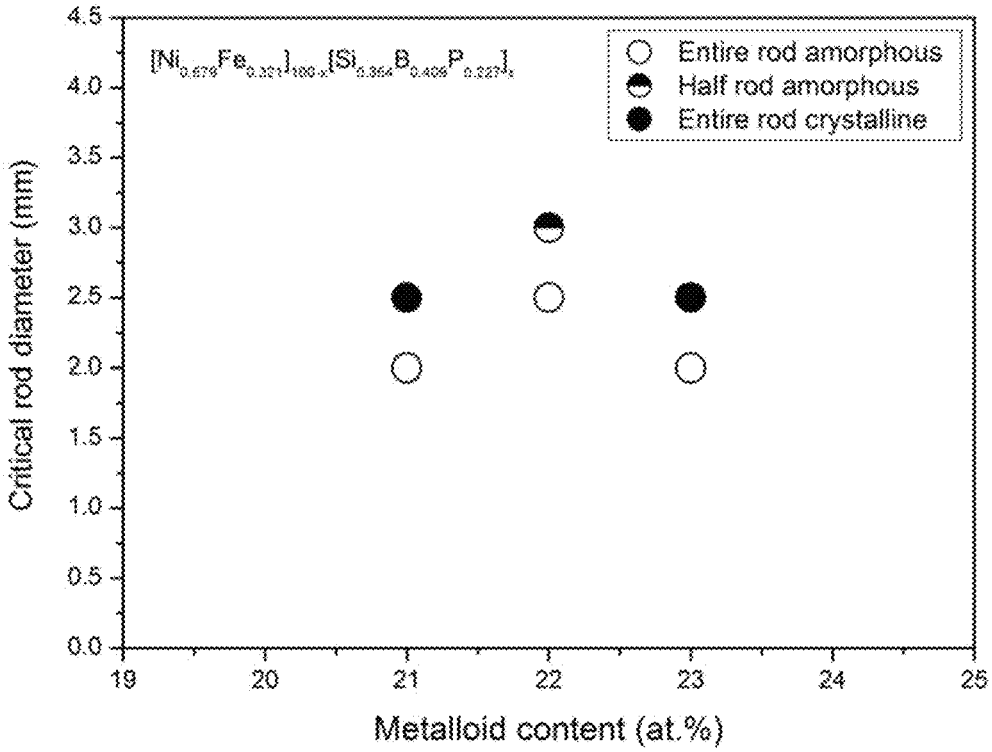
FIG. 8 provides data plots showing the effect of varying the total metalloid content at the expense of the total metal content on the GFA of the Ni—Fe—Si—B—P alloys according to the formula $(Ni_{0.679}Fe_{0.321})_{100-x}(Si_{0.364}B_{0.409}P_{0.227})_x$, where the total metalloid atomic percent x ranges from 21 to 23 in accordance with embodiments of the disclosure.
Figure 9:
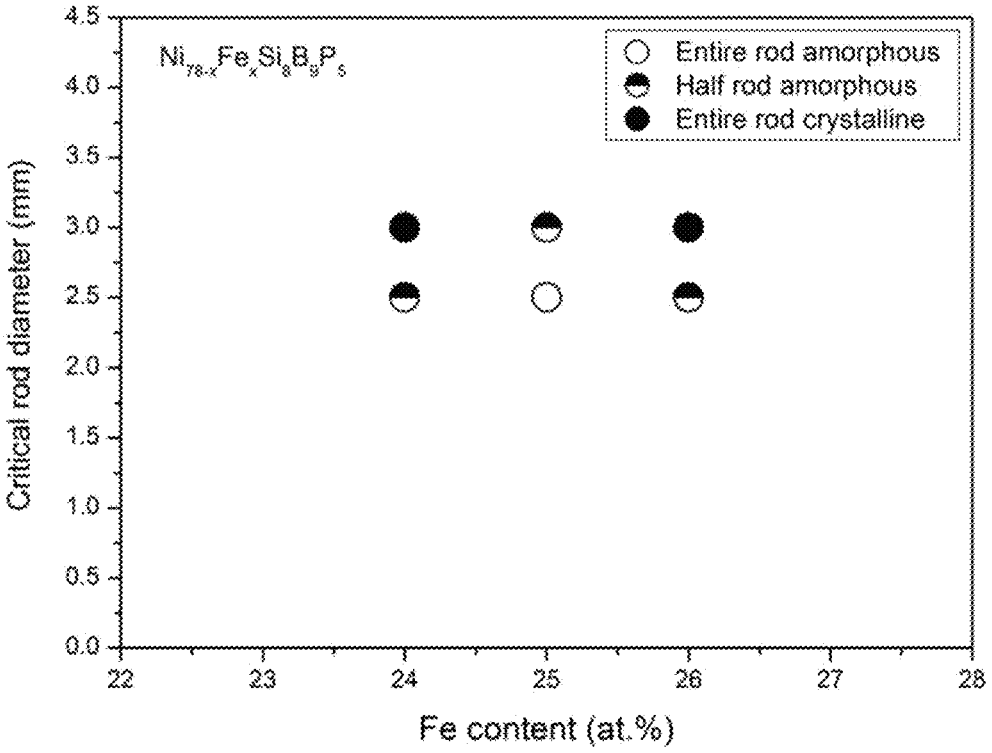
FIG. 9 provides data plots showing the effect of substituting Ni by Fe on the GFA of the Ni—Fe—Si—B—P alloys according to the formula $Ni_{78-x}Fe_xSi_8B_9P_5$, where the Fe atomic percent x ranges from 24 to 26 in accordance with embodiments of the disclosure.

Example alloys 21, 27, and 28 demonstrate the effect of varying the total metalloid content at the expense of the total metal content on the GFA of the Ni—Fe—Si—B—P alloys according to the formula $(Ni_{0.679}Fe_{0.321})_{100-x}(Si_{0.364}B_{0.409}P_{0.227})$, where metalloid atomic percent x ranges from 21 to 23. FIG. 8 provides data plots showing the effect of varying the total metalloid content at the expense of the total metal content, on the GFA of the Ni—Fe—Si—B—P alloys. Alloys having the formula $(Ni_{0.679}Fe_{0.321})_{100-x}(Si_{0.364}B_{0.409}P_{0.227})$, where the total metalloid atomic percent x ranges from 21 to 23 in accordance with embodiments of the disclosure, can produce metallic glass rods having diameters of at least 2 mm. When the metalloid content is 22 at %, a metallic glass rod having a diameter of 3 mm can be formed. When a combined composition of Si, B and P (b+c+d) is between 21 and 23, Ni—Fe—Si—B—P metallic glass rods with diameters of at least 2 mm are formed Example alloys 21, 29, and 30 demonstrate the effect of varying the atomic concentration of Fe at the expense of Ni on the GFA of the Ni—Fe—Si—B—P alloys according to the formula $Ni_{78-x}Fe_xSi_8B_9P_5$, where atomic percent of Fe x ranges from 24 to 26. FIG. 9 provides data plots of these results. The plots point to x=25 as the Fe content at which the largest metallic glass rod of 3 mm in diameter could be formed.

The effect of incorporating Cr as a replacement for Ni according to the formula $Ni_{53-x}Fe_{25}Cr_xSi_8B_9P_5$, where the atomic percent of Cr x ranges from 0 to 4 is illustrated in example alloys 31-33 and Table 4. These alloys are processed in quartz capillaries at 1300° C. As shown, incorporating Cr in the Ni—Fe—Si—B—P alloys degrades the glass-forming ability slightly if the Cr atomic concentration is less than 3%. Specifically, the critical rod diameter $d_c$ reduces from 3 mm to 2.6 mm when Cr addition is 2 at %. Also, the glass forming ability degrades more drastically if the Cr atomic concentration is more than 3%. Specifically, the critical rod diameter $d_c$ reduces from 2.6 mm to below 1 mm when Cr addition is 4 at %. Therefore, the desirable Cr addition ranges from 0 to 3 at %.

TABLE 4

Example alloys according to the formula $Ni_{53-x}Fe_{25}Cr_xSi_{8.5}B_{9.5}P_4$ processed in quartz capillaries to form metallic glasses

| Example | Composition [at %] | $d_c$ [mm] | $t_w$ [mm] |
|---|---|---|---|
| 31 | $Ni_{53}Fe_{25}Si_{8.5}B_{9.5}P_4$ | 3.0 | 0.3 |
| 32 | $Ni_{51}Fe_{25}Cr_2Si_{8.5}B_{9.5}P_4$ | 2.6 | 0.26 |
| 33 | $Ni_{49}Fe_{25}Cr_4Si_{8.5}B_{9.5}P_4$ | <1.0 | 0.1 |

The effect of fluxing the Ni—Fe—Si—B—P alloys with boron oxide on the GFA is also explored. As shown in Table 5, the alloy $Ni_{53}Fe_{25}Si_8B_9P_5$ having the same composition, but being fluxed, had a $d_c$ of 3 mm. If the alloy is not fluxed with boron oxide, the critical rod diameter is less than 1 mm.

TABLE 5

Effect of fluxing the alloys with boron oxide on GFA

| Example | Composition [at %] | Fluxing | $d_c$ [mm] | $t_w$ [mm] |
|---|---|---|---|---|
| 21 | $Ni_{53}Fe_{25}Si_8B_9P_5$ | Fluxed | 3.0 | 0.5 |
| 21 | $Ni_{53}Fe_{25}Si_8B_9P_5$ | Unfluxed | <1 | 0.5 |

The measured mechanical properties include compressive yield strength, notch toughness, and bending ductility.

Figure 10:
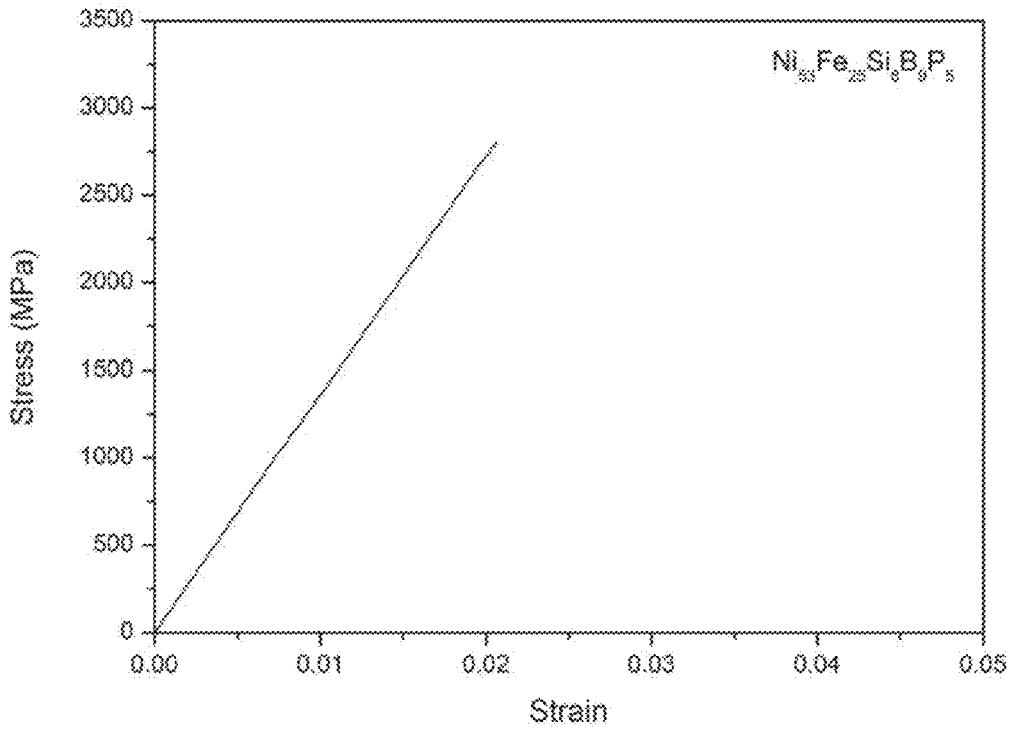
FIG. 10 provides a compressive stress-strain diagram for example metallic glass $Ni_{53}Fe_{25}Si_9B_8P_5$.

The compressive yield strength, $\sigma_y$, is the measure of the material's ability to resist non-elastic yielding. The yield strength is the stress at which the material yields plastically. A high $\sigma_y$ ensures that the material will be strong. The compressive stress-strain diagram of example metallic glass $Ni_{53}Fe_{25}Si_9B_8P_5$ is presented in FIG. 10. The compressive yield strength for this metallic glass is determined to be 2800 MPa. The compressive yield strength of all metallic glasses according to the current disclosure is expected to be over 2500 MPa.

The stress intensity factor at crack initiation (i.e. the notch toughness), $K_q$, is the measure of the material's ability to resist fracture in the presence of a notch. The notch toughness is a measure of the work required to propagate a crack originating from a notch. A high $K_q$ ensures that the material will be tough in the presence of defects. The notch toughness of example metallic glass $Ni_{53}Fe_{25}Si_9B_8P_5$ is measured to be 28.5±1.5 MPa $m^{1/2}$. The notch toughness of all metallic glasses according to the current disclosure is expected to be over 20 MPa $m^{1/2}$.

Figure 11:
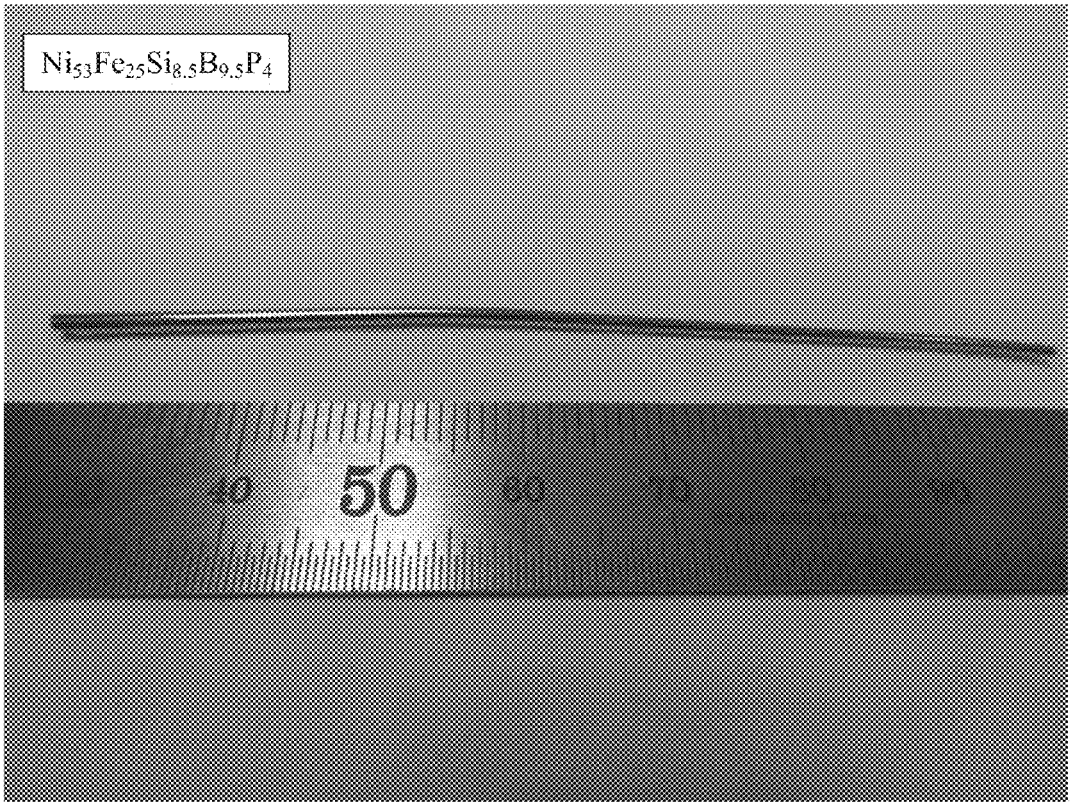
FIG. 11 provides an image of a plastically bent 1 mm amorphous rod of example metallic glass $Ni_{53}Fe_{25}Si_{8.5}B_{9.5}P_4$ in accordance with embodiments of the disclosure.

Bending ductility is a measure of the material's ability to deform plastically and resist fracture in bending in the absence of a notch or a pre-crack. A high bending ductility ensures that the material will be ductile in a bending overload. The metallic glasses Ni—Fe—Si—B or Ni—Fe—Si—B—P were found to exhibit a remarkable bending ductility, as rods of the metallic glasses are capable of undergoing macroscopic plastic deformation under a bending load at diameters as large a 1 mm or larger. An image of a plastically bent 1 mm amorphous rod of example metallic glass $Ni_{53}Fe_{25}Si_{8.5}B_{9.5}P_4$ is presented in FIG. 11.

A plastic zone radius, $r_p$, defined as $K_q^2/\pi\sigma_y^2$, is a measure of the critical flaw size at which catastrophic fracture is promoted. The plastic zone radius determines the sensitivity of the material to flaws; a high $r_p$ designates a low sensitivity of the material to flaws. The notch plastic zone radius of example metallic glass $Ni_{53}Fe_{25}Si_9B_8P_5$ is estimated to be 33 μm. The plastic zone radius of all metallic glasses according to the current disclosure is expected to be over 10 μm.

Figure 12:
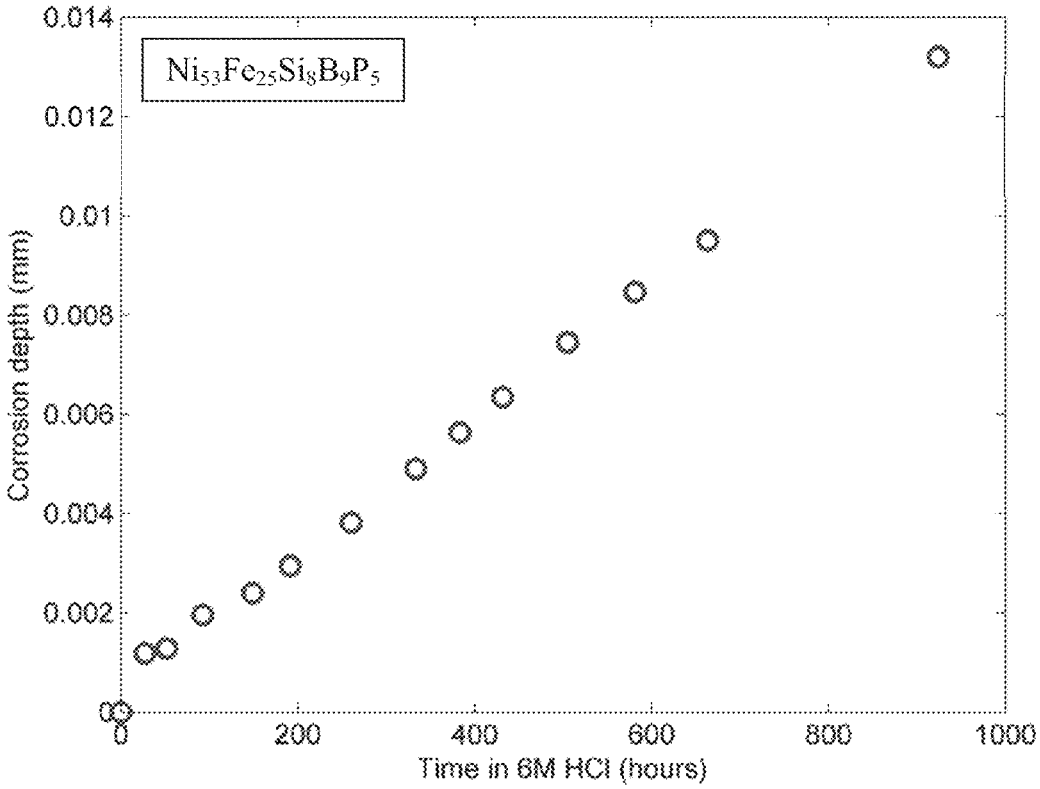
FIG. 12 provides a plot of the corrosion depth versus time in 6M HCl solution of a 2 mm metallic glass rod having composition $Ni_{53}Fe_{25}Si_9B_8P_5$.

The metallic glasses also exhibit good corrosion resistance. The corrosion resistance of example metallic glass $Ni_{53}Fe_{25}Si_9B_8P_5$ has been evaluated by immersion test in 6M HCl. A plot of the corrosion depth versus time is presented in FIG. 12. The corrosion depth at approximately 924 hours is measured to be about 13 micrometers. The corrosion rate is estimated to be 0.125 mm/year. The corrosion rate of all metallic glasses according to the current disclosure is expected to be under 1 mm/year.

Lastly, alloys containing Fe at atomic concentrations of at least about 20% are found to be magnetic. Bulk metallic glass cores made from such alloys therefore may be useful as ferromagnets for power electronics applications, with non-limiting applications selected from the group consisting of inductors, transformers, clutches, and DC/AC converters.

Description of Methods of Forming Alloy Compositions and Metallic Glass Articles A particular method for producing the alloy ingots of the disclosure involves inductive melting of the appropriate amounts of elemental constituents in a fused silica crucible under inert atmosphere. Alternatively, the melting crucible may also be crystalline silica, a ceramic such as alumina or zirconia, graphite, or a water-cooled hearth made of copper or silver. Particular purity levels of the constituent elements were as follows: Ni 99.995%, Fe 99.95%, Cr 99.996%, Si 99.9999%, B 99.5%, and P 99.9999%.

In some embodiments, prior to producing an amorphous article, the alloyed ingots can be fluxed with a reducing agent such as dehydrated boron oxide ($B_2O_3$) by re-melting the ingots in a quartz tube under inert atmosphere. The alloy melt is brought in contact with the boron oxide melt. The two melts to interact for a period of time, e.g. about 1000 s, at high temperature, e.g. between 1150 and 1350° C., under inert atmosphere. The mixture is quenched in a bath of room temperature water to form fluxed alloy ingots. In various alternate embodiments, the bath can be iced water or oil. The example alloys presented in the current disclosure have been fluxed according to the method described above.

Various methods for producing metallic glass rods from the alloys of the disclosure include re-melting the fluxed alloy ingots in quartz capillaries or tubes in a furnace at high temperature, e.g. between 1150 and 1350° C. under high purity argon, and rapidly quenching in a room-temperature water bath. The wall thickness of the quartz tube can vary from 0.05 mm to 0.5 mm. The example alloys presented in the current disclosure were produced according to the method described above. The wall thickness of the quartz capillaries used were about 10% of the quartz inner diameter, while the wall thickness of the quartz tubes were 0.5 mm.

Optionally, amorphous articles from the alloys of the disclosure can also be produced by re-melting the fluxed alloy ingots and injecting or pouring the molten alloy into a metal mold made for example of copper, brass, or steel.

Test Methodology for Assessing Glass Forming Ability

The glass-forming ability of each alloy was assessed by determining the maximum rod diameter in which the amorphous phase of the alloy (i.e. the metallic glass phase) could be formed when processed by the quartz water quenching method described above. X-ray diffraction with Cu-Kα radiation was performed to verify the amorphous structure of the alloys.

Test Methodology for Differential Scanning Calorimetry

Differential scanning calorimetry was performed on sample metallic glasses at a scan rate of 20 K/min to determine the glass-transition, crystallization, solidus, and liquidus temperatures of sample metallic glasses.

Test Methodology for Measuring Notch Toughness

The notch toughness of sample metallic glasses was determined on 2-mm diameter rods. The rods were notched using a wire saw with a root radius ranging from 0.10 to 0.13 μm to a depth of approximately half the rod diameter. The notched specimens were placed on a 3-point bending fixture with span distance of 12.7 mm and carefully aligned with the notched side facing downward. The critical fracture load was measured by applying a monotonically increasing load at constant cross-head speed of 0.001 mm/s using a screw-driven testing frame. Two tests were performed, and the average value and associated variance are presented. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Compressive Yield Strength

Compression testing of sample metallic glasses was performed on cylindrical specimens 2 mm in diameter and about 4 mm in length. A monotonically increasing load was applied at a constant cross-head speed of 0.001 mm/s using a screw-driven testing frame. The strain was measured using a linear variable differential transformer. The compressive yield strength was estimated as the maximum stress attained prior to failure.

Test Methodology for Measuring Corrosion Resistance

The corrosion resistance of sample metallic glasses was evaluated by immersion tests in hydrochloric acid (HCl). A rod of metallic glass sample with initial diameter of 1.91 mm, and a length of 16.13 mm was immersed in a bath of 6M HCl at room temperature. The density of the metallic glass rod was measured using the Archimedes method to be 7.64 g/cc. The corrosion depth at various stages during the immersion was estimated by measuring the mass change with an accuracy of ±0.01 mg. The corrosion rate was estimated assuming linear kinetics.

The disclosed Ni—Fe—Si—B or Ni—Fe—Si—B—P alloys have good glass forming ability, along with very high strength and good corrosion resistance. The combination of high glass-forming ability and the mechanical and corrosion performance of the bulk Ni—Fe based metallic alloys makes them excellent candidates for various engineering applications. Among these applications, the disclosed alloys can be used to form a bulk ferromagnetic core, which itself can be used for various applications, including but not limited to inductors, transformers, clutches, and DC/AC converters.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An alloy comprising Fe in atomic percent a between 5 and 50, Si in atomic percent b between 10 and 14, B in atomic percent c between 9 and 13, the balance is Ni, and wherein the alloy is capable of forming a metallic glass rod having a diameter of at least 1 mm.

2. The alloy of claim 1, wherein the Fe atomic percent a is between 15 and 50, and the diameter of the metallic glass rod that can be formed is at least 1 mm.

3. The alloy of claim 1, wherein the Fe atomic percent a is between 25 and 40, and the diameter of the metallic glass rod that can be formed is at least 2 mm.

4. The alloy of claim 1, wherein a combined atomic percent of Si and B is between 21 and 24.

5. The alloy of claim 1, wherein up to 3 atomic % of Ni or Fe is substituted by Cr.

6. The alloy of claim 1, wherein up to 1.5 atomic % of Fe or Ni is substituted by Co, Mn, W, Mo, Ru, Re, Cu, Pd, Pt, Nb, V, Ta, or a combination thereof.

7. A metallic glass comprising the alloy of claim 1.

8. An alloy comprising composition selected from a group consisting of $Ni_{52}Fe_{25}Si_{12}B_{11}$, $Ni_{47}Fe_{30}Si_{12}B_{11}$, $Ni_{44.5}Fe_{32.5}Si_{12}B_{11}$, $Ni_{42}Fe_{35}Si_{12}B_{11}$, $Ni_{39.5}Fe_{37.5}Si_{12}B_{11}$, $Ni_{37}Fe_{40}Si_{12}B_{11}$, $Ni_{53}Fe_{25}Si_{8}B_{10}P_{4}$, $Ni_{53}Fe_{25}Si_{8}B_{9}P_{5}$, $Ni_{53}Fe_{25}Si_{9}B_{9}P_{4}$, $Ni_{53}Fe_{25}Si_{7}B_{9}P_{6}$, $Ni_{53}Fe_{25}Si_{7}B_{10}P_{5}$, $Ni_{53.68}Fe_{25.32}Si_{7.64}B_{8.59}P_{4.77}$, $Ni_{52.32}Fe_{24.68}Si_{8.36}B_{9.41}P_{5.23}$, $Ni_{54}Fe_{24}Si_{8}B_{9}P_{5}$, and $Ni_{52}Fe_{26}Si_{8}B_{9}P_{5}$, wherein the alloy is capable of forming a metallic glass rod having a diameter of at least 1 mm.

9. An alloy comprising Fe in atomic percent a between 5 and 50, Si in atomic percent b between 7 and 10, B in atomic percent c between 7 and 10, and P in atomic percent d between 0.5 and 8, the balance is Ni, and wherein the alloy is capable of forming a metallic glass rod having a diameter of at least 1 mm.

10. The alloy of claim 9, wherein a is between 20 and 45, and the diameter of the metallic glass rod that can be formed when processed by water quenching a high temperature melt in a quartz tube having wall thickness of 0.5 mm is at least 2 mm.

11. The alloy of claim 9, wherein a combined atomic percent of Si B and P is between 21 and 23.

12. The alloy of claim 9, wherein up to 3 atomic % of Ni or Fe is substituted by Cr.

13. The alloy of claim 9, wherein up to 1.5 atomic % of Fe or Ni is substituted by Co, Mn, W, Mo, Ru, Re, Cu, Pd, Pt, Nb, V, Ta, or a combination thereof.

14. A metallic glass comprising the alloy of claim 9.

15. A method of producing the metallic glass of claim 14 comprising:

melting the alloy into a molten state; and quenching the melt at a cooling rate sufficiently rapid to prevent crystallization of the alloy.

16. The method of claim 15, further comprising fluxing the melt with a reducing agent prior to quenching.

17. The method of claim 16, wherein the reducing agent is boron oxide.

18. The method of claim 15, the step of melting the alloy comprises melting the alloy in a crucible, the crucible made of fused silica, a ceramic, alumina, zirconia, or graphite, or in a water-cooled hearth made of copper or silver.

19. The method of claim 15, the step of quenching the melt comprises quenching a crucible containing the molten alloy in a bath of room temperature water, iced water, or oil.

20. The method of claim 15, the step of quenching the melt comprises injecting or pouring the molten alloy into a metal mold.

* * * * *